US009431203B2

(12) United States Patent
Doblack et al.

(10) Patent No.: US 9,431,203 B2
(45) Date of Patent: Aug. 30, 2016

(54) REFLOWABLE CIRCUIT PROTECTION DEVICE

(75) Inventors: Shelomon Patrick Doblack, Santa Clara, CA (US); Jianhua Chen, Sunnyvale, CA (US); Matthew P. Galla, Holly Springs, NC (US)

(73) Assignee: Littelfuse, Inc., Chicago, IL (US)

( * ) Notice: Subject to any disclaimer, the term of this patent is extended or adjusted under 35 U.S.C. 154(b) by 689 days.

(21) Appl. No.: 13/567,245

(22) Filed: Aug. 6, 2012

(65) Prior Publication Data

US 2014/0035716 A1 Feb. 6, 2014

(51) Int. Cl.

| | |
|---|---|
| ***H01H 85/36*** | (2006.01) |
| ***H01H 37/76*** | (2006.01) |
| *H01H 37/04* | (2006.01) |

(52) U.S. Cl.

CPC ..... *H01H 85/36* (2013.01); *H01H 37/761* (2013.01); *H01H 2037/046* (2013.01); *H01H 2037/762* (2013.01)

(58) Field of Classification Search

CPC ..... H01H 85/36; H01H 37/761; H01H 2037/046; H01H 2037/762

USPC ..... 337/401, 402, 407–409, 148, 152, 153, 337/297

See application file for complete search history.

(56) References Cited

U.S. PATENT DOCUMENTS 3,638,083 A * 1/1972 Dornfeld ..... H01G 2/14 337/297
3,725,835 A * 4/1973 Hopkins ..... G11B 21/12 337/140
3,846,679 A * 11/1974 Jost ..... H01R 4/01 219/212
4,276,532 A * 6/1981 Aoki ..... H01H 37/765 337/407
4,544,988 A * 10/1985 Hochstein ..... H01H 61/0107 337/140
4,864,824 A * 9/1989 Gabriel ..... F03G 7/065 60/527
5,014,036 A * 5/1991 Komoto ..... H01H 9/102 337/4
5,363,083 A 11/1994 Fischer
5,831,507 A * 11/1998 Kasamatsu ..... H01H 9/10 337/299

(Continued)

FOREIGN PATENT DOCUMENTS

CN 102522263 A 6/2012
DE 102008057166 A1 5/2010

(Continued)

OTHER PUBLICATIONS

International Search Report for International Application No. PCT/US2013/053731 mailed Jan. 29, 2014.

(Continued)

*Primary Examiner* — Anatoly Vortman

(57) ABSTRACT

A circuit protection device includes a housing, which includes first and second electrodes. The device includes a conductive slider inside the housing. At a first location within the housing, the slider provides an electrical connection between the first and second electrodes. At a second location within the housing, the slider does not provide the electrical connection. A spring is secured to and stretched between the slider and an inner side of the housing such that the spring is held in tension in an expanded state. The slider is held at the first location by a solder between the slider and the first and second electrodes. After the device is armed, detection of an over-temperature condition causes the solder to begin to melt and the spring to compress and pull the slider to the second location within the housing, thus severing the electrical connection between the first and second electrodes.

15 Claims, 19 Drawing Sheets

(56) References Cited

U.S. PATENT DOCUMENTS

| | | | | |
|---|---|---|---|---|
| 6,348,851 | B1 * | 2/2002 | Wyser | H01H 37/761 337/393 |
| 6,396,382 | B1 * | 5/2002 | Ross | H01H 1/0036 337/393 |
| 6,917,276 | B1 * | 7/2005 | Menard | F03G 7/065 337/14 |
| 7,345,570 | B2 * | 3/2008 | Kawanishi | H01H 37/764 337/142 |
| 7,385,474 | B2 * | 6/2008 | Kawanishi | H01H 37/76 337/142 |
| 7,474,194 | B2 * | 1/2009 | Darr | H01H 9/104 337/59 |
| 7,576,630 | B2 * | 8/2009 | Darr | H01H 9/104 337/143 |
| 7,864,024 | B2 * | 1/2011 | Schlenker | H01H 37/761 337/239 |
| 8,289,122 | B2 * | 10/2012 | Matthiesen | H01H 37/761 337/167 |
| 8,665,057 | B2 * | 3/2014 | Schlenker | H01H 37/761 337/239 |
| 2006/0273876 | A1 * | 12/2006 | Pachla | H05K 1/0201 337/140 |
| 2010/0033295 | A1 * | 2/2010 | Kent | H01H 37/765 337/405 |
| 2010/0245022 | A1 | 9/2010 | Galla et al. | |
| 2010/0245027 | A1 | 9/2010 | Matthiesen et al. | |
| 2012/0194315 | A1 * | 8/2012 | Matthiesen | H01H 37/761 337/142 |
| 2012/0194317 | A1 * | 8/2012 | Vranicar | H01H 37/761 337/401 |
| 2012/0194958 | A1 | 8/2012 | Matthiesen et al. | |

FOREIGN PATENT DOCUMENTS

| | | | |
|---|---|---|---|
| DE | 102009036578 | B3 | 9/2010 |
| EP | 0575783 | A1 | 12/1993 |
| EP | 1942389 | A1 | 9/2008 |

OTHER PUBLICATIONS

Search Report for Chinese Application No. 201380041636.4, accompanying office action dated Jan. 22, 2016.

* cited by examiner

REFLOWABLE CIRCUIT PROTECTION DEVICE

BACKGROUND

I. Field

The present invention relates generally to electronic protection circuitry. More, specifically, the present invention relates to a reflowable surface mount circuit protection device, which may also be adapted to a weldable or pluggable installation.

II. Background Details

Protection circuits are often times utilized in electronic circuits to isolate failed circuits from other circuits. For example, the protection circuit may be utilized to prevent electrical or thermal fault condition in electrical circuits, such as in lithium-ion battery packs. Protection circuits may also be utilized to guard against more serious problems, such as a fire caused by a power supply circuit failure.

One type of protection circuit is a thermal fuse. A thermal fuse functions similar to that of a typical glass fuse. That is, under normal operating conditions the fuse behaves like a short circuit and during a fault condition the fuse behaves like an open circuit. Thermal fuses transition between these two modes of operation when the temperature of the thermal fuse exceeds a specified temperature. To facilitate these modes, thermal fuses include a conduction element, such as a fusible wire, a set of metal contacts, or set of soldered metal contacts, that can switch from a conductive to a non-conductive state. A sensing element may also be incorporated. The physical state of the sensing element changes with respect to the temperature of the sensing element. For example, the sensing element may correspond to a low melting metal alloy or a discrete melting organic compound that melts at an activation temperature. When the sensing element changes state, the conduction element switches from the conductive to the non-conductive state by physically interrupting an electrical conduction path.

In operation, current flows through the fuse element. Once the sensing element reaches the specified temperature, it changes state and the conduction element switches from the conductive to the non-conductive state.

One disadvantage of some existing thermal fuses is that during installation of the thermal fuse, care must be taken to prevent the thermal fuse from reaching the temperature at which the sensing element changes state. As a result, some existing thermal fuses cannot be mounted to a circuit panel via reflow ovens, which operate at temperatures that will cause the sensing element to open prematurely.

Thermal fuses described in U.S. patent application Ser. No. 12/383,595, filed Mar. 24, 2009 and published as U.S. Publication No. 2010/0245022, and U.S. application Ser. No. 12/383,560, filed Mar. 24, 2009 and published as U.S. Publication No. 2010/0245027—the entirety of each of which is incorporated herein by reference—address the disadvantages described above. While progress has been made in providing improved circuit protection devices, there remains a need for improved circuit protection devices.

SUMMARY OF THE INVENTION

A circuit protection device includes a housing, which includes first and second electrodes. The device includes a conductive slider inside the housing. At a first location within the housing, the slider provides an electrical connection between the first and second electrodes. At a second location within the housing, the slider does not provide the electrical connection. A spring is secured to and stretched between the slider and an inner side of the housing such that the spring is held in tension in an expanded state. The slider is held at the first location by a solder between the slider and the first and second electrodes. After the device is armed, detection of an over-temperature condition causes the solder to begin to melt and the spring to compress and pull the slider to the second location within the housing, thus severing the electrical connection between the first and second electrodes.

DETAILED DESCRIPTION

Figure 1:
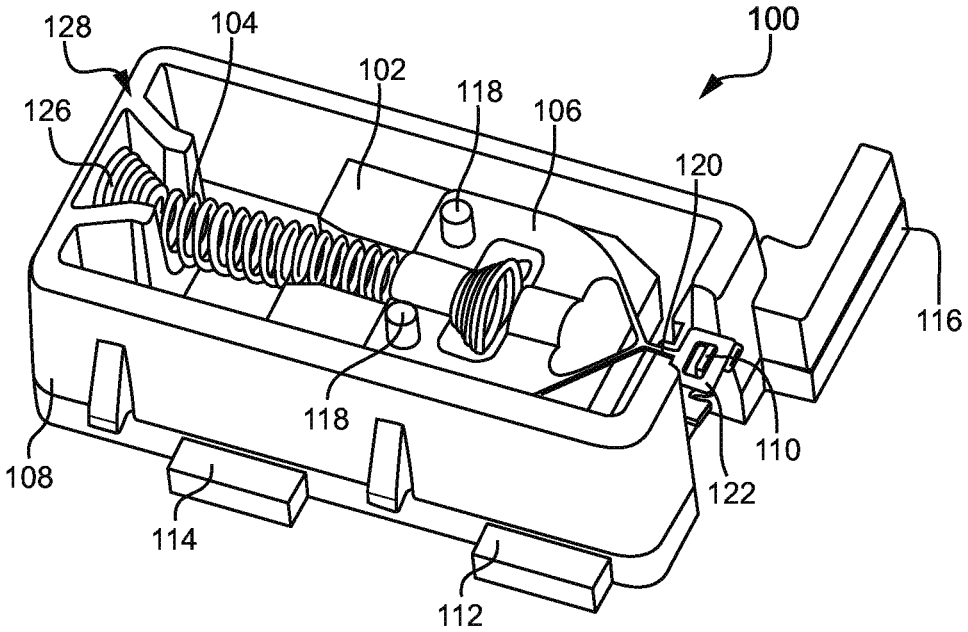
FIG. 1 is a reflowable surface mount circuit protection device prior to being armed.

FIG. 1 is a reflowable surface mount circuit protection device 100 prior to being armed. The device 100 includes a slider 102, spring 104, and a fusible element 106 inside of a housing 108. In FIG. 1, the spring 104 is a helical tension spring. The housing 108 includes an arming pin 110 and electrodes 112, 114. The electrodes may be, for example, surface mount pads for connecting the device 100 to the circuit to be protected. The housing 108 includes an arm 116. A bottom surface of the end of the arm 116 includes an arming pad that is electrically connected to the arming pin 110 through the housing 108. An arming current (discussed below) is applied to the arming pin 110 via the arming pad.

The slider 102 may be made of a conductive material such as copper. In the embodiment shown in FIG. 1, the slider 102 includes two protrusions 118 extending from an upper surface of the slider 102. The fusible element 106 includes two openings that fit over the protrusions 118, securing the fusible element 106 to the slider 102. While FIG. 1 shows a slider having two protrusions, it will be understood that in other embodiments the slider may include a different number of protrusions, and the fusible element may include a number of openings to match the number of protrusions in the slider. Other attachment methods may be used including laser welding, and mechanical fasteners such as with an adhesive, screws, rivets, etc. In some embodiments in which other attachment methods are used, the slider 102 may omit the protrusions 118.

The device 100 also includes a fusible link 120 and an arming pin connector 122 connected to the fusible link 120. The fusible link 120 may be made of the same material and be integrally connected with the fusible element 106. The arming pin connector 122 includes a loop, or opening, that hooks over the arming pin 110, providing an electrical connection between the arming pin and the fusible link 120. The fusible link 120 provides an electrical and mechanical connection between the fusible element 106 and the arming pin 110 until the fusible link 120 is blown (discussed below).

The slider 102 includes a pocket in which a portion of the spring 104 is inserted. In FIG. 1 the pocket is a depression defined in the slider 102 that is sufficiently deep such that all or a substantial part of the portion of the spring 104 inserted in the pocket is below the upper surface of the slider 102. It will be appreciated that in other embodiments, the pocket may be more shallow and receive a portion of the head of the spring 104, such as in FIG. 6. In FIG. 1 the spring 104 is shown to be in tension in an expanded state. One end 124 of the spring 104 is inserted into the pocket of the slider 102. The other end 126 of the spring 104 is stretched to and inserted into an overmold portion 128 of the housing 108. The fusible element 106 may include a portion that covers part of the spring 104 to help hold the spring 104 in place.

The slider 102 may be soldered to the bottom of the inside of the housing 108, which holds the slider 102 in place (resisting the compression force of the spring 104 held in tension) after the device 100 is installed in a circuit to be protected. The slider 102 provides an electrical connection between the electrodes 112 and 114.

The melting point of the solder holding the slider 102 in place may be lower than a reflow temperature. The fusible link 120, which is made of a material that allows it to open at a temperature higher than that of the reflow temperature and thus may have a melting point higher than that of the reflow temperature, is provided to hold the slider 102 and fusible element 106 in place during reflow. After reflow and when the device 100 is installed in the device to be protected, an arming current is applied to the arming pin 110 and through the fusible link 120 that causes the fusible link 120 to open. With the fusible link 120 open, the device 100 is armed. If the circuit to be protected overheats, causing the solder holding the slider 102 in place to begin to melt, the force of the spring 104 pulls the slider 102 to an open position in which there is no longer an electrical connection between the electrodes 112 and 114, thus protecting the circuit from overheating.

The following are examples of dimensions for the device. The device 100 may be approximately 11.6 mm long, approximately 8.2 mm wide on the end of the device 100 with the arm 116, approximately 6.2 mm wide on the other end of the device 100, and approximately 3.4 mm in height. The arm 116 of the housing may be approximately 1.4 mm wide.

It will be appreciated that the arming pad (located at the bottom surface of the arm 116 in FIG. 1) may be located at different locations on the housing 108. For example, the arming pad may be located between the electrodes 114 and 112 with an electrical connection to the arming pin 122. In this example, the housing 108 may omit the arm 116.

Figure 2:
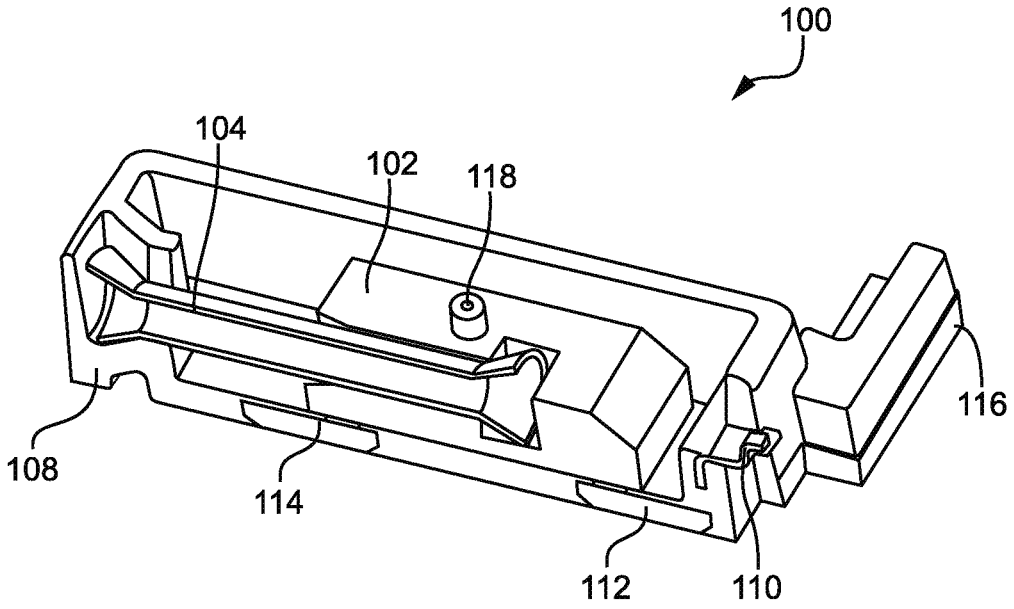
FIG. 2 shows a cross sectional view of the device shown in FIG. 1 in a closed position.

FIG. 2 shows a cross sectional view of the device 100 in a closed position. For the purposes of illustration, certain elements of the device 100, e.g., the fusible element 106, are not shown. The slider 102 provides a conductive path between the electrodes 112 and 114.

Figure 3:
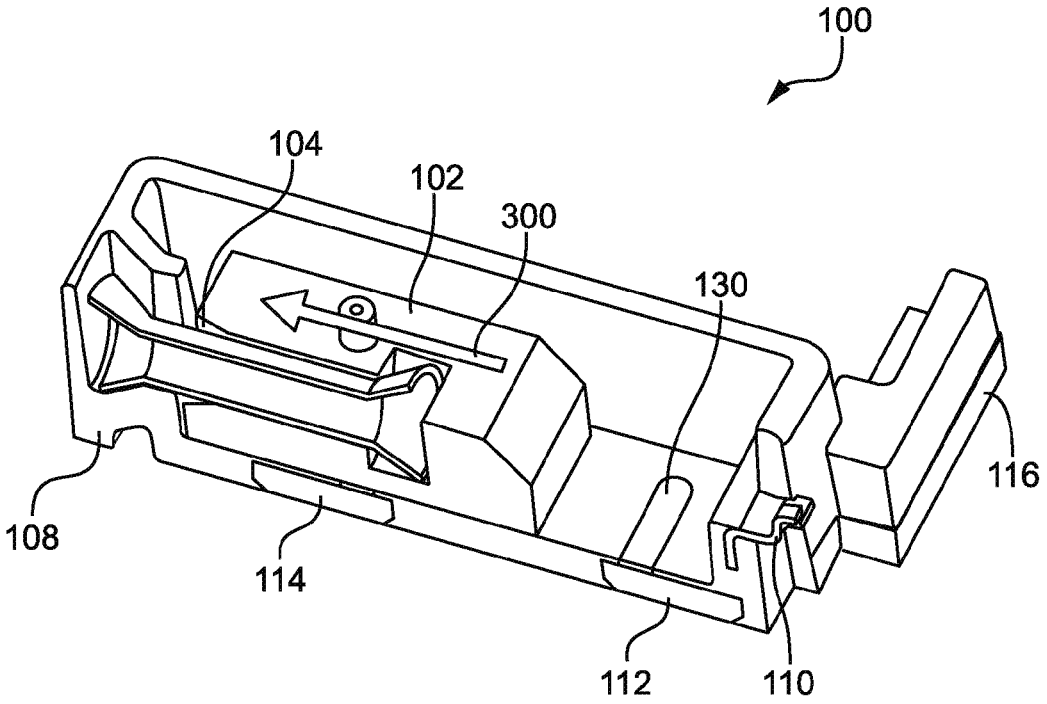
FIG. 3 shows a cross sectional view of the device shown in FIG. 1 in an open position.

FIG. 3 shows a cross sectional view of the device 100 in an open position. If, for example, the circuit to which the device 100 is connected overheats to an overtemperature condition, causing the solder holding the slider 102 in place to begin to melt, the spring 104 pulls the slider 102 in the direction indicated by the arrow 300. In this manner, the electrical connection between the electrodes 112 and 114 is severed, thus protecting the outside circuit from overheating. Element 130 indicates where the solder is provided above the electrode 112. While not visible in FIG. 3, solder is similarly provided above the electrode 114.

Figure 4A:
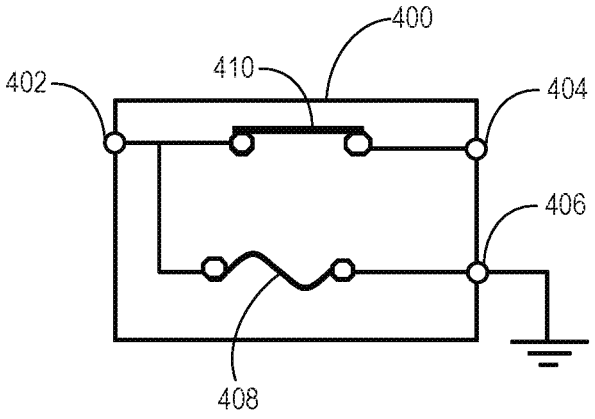
FIG. 4*a* is a circuit representation of an exemplary circuit protection device for protecting a circuit external to the device.
Figure 4B:
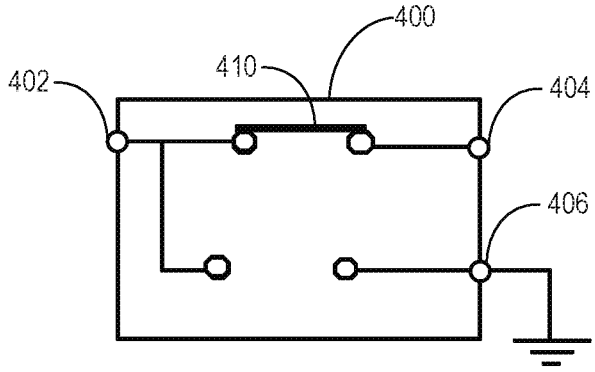
FIG. 4*b* is a circuit representation of the circuit of FIG. 4*a* with the fusible link blown and the slider in the closed position.
Figure 4C:
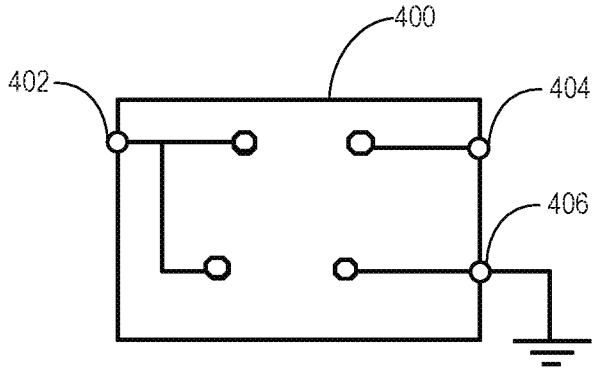
FIG. 4*c* is a circuit representation of the circuit of FIG. 4*b* with the slider in the open position.

FIGS. 4*a*-4*c* are a circuit representation 400 of an exemplary circuit protection device for protecting a circuit external to the device. The circuit 400 includes electrodes 402 and 404, which may correspond to the electrodes 112 and 114, respectively, shown in FIG. 1. Electrode 406 corresponds to the arming pin 110 shown in FIG. 1. The circuit 400 also includes a fusible link 408 connected to the electrode 406 (arming pin 110). An arming current may be applied to the fusible 408 through the electrode 406. The circuit 400 also includes a conductive element 410 between the electrodes 402, 404, which may correspond to the slider 102 shown in FIG. 1. For the sake of explanation, the circuit protection device can be positioned in series between circuit components to be protected, such as one or more FETs. It will be understood that the circuit protection device may be used in other circuit configurations.

FIG. 4*a* shows the circuit 400 before the fusible link 408 is blown, i.e., before the device is armed. FIG. 4*b* shows the circuit 400 after the fusible link 408 is blown. Further, in FIGS. 4*a*-4*b* the slider 410 is in the closed position, thus bridging and providing an electrical connected between electrodes 402, 404. FIG. 4*c* shows the circuit 400 in the open position in which the electrical connected between the electrodes 402, 404 is severed, such as after an overtemperature condition is detected.

Figure 5A:
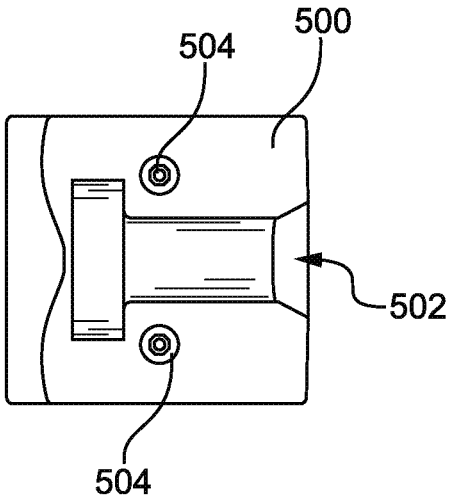
FIGS. 5*a*-5*f* illustrate exemplary assembly steps a circuit protection device.

FIGS. 5*a*-5*f* illustrate exemplary assembly steps a circuit protection device, such as the device 100 shown in FIG. 1. FIG. 5*a* illustrates that a slider 500 is provided. The slider 500 may be made of a conductive material, such as copper. The slider 500 includes a pocket 502 shaped to accept a spring (see FIG. 2*b*). The slider 500 also includes protrusions 504 that extend up from an upper surface of the slider 500. Other attachment methods may be used including laser welding, and mechanical fasteners such as with an adhesive, screws, rivets, etc.

Figure 5B:
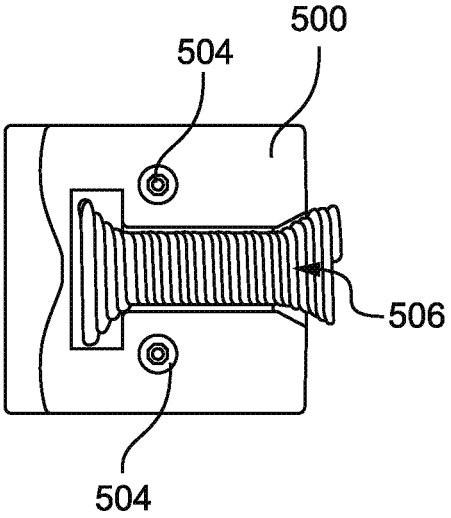

FIG. 5*b* shows that a spring 506 is placed in the pocket 502. The spring 506 may be a coil spring or other spring element having elasticity and being capable of being brought into tension through expansion.

Figure 5C:
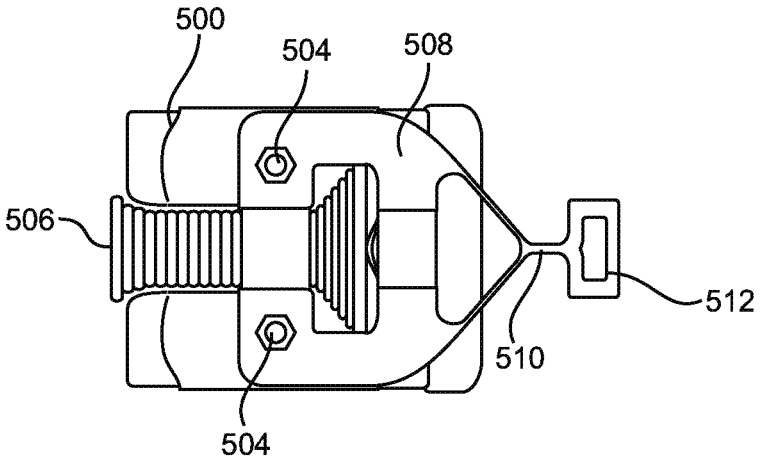

FIG. 5*c* shows that a fusible element 508 is placed on top of at least a part of the slider 500. The fusible element 508 includes two openings that fit over the protrusions 504 extending from the slider 500. The fusible element 508 may be joined onto the slider 500 using known stamping techniques. A fusible link 510 is connected to the fusible element 508 at a side of the fusible element 508 opposite to the side of element 508 near the openings. An arming pin connector 512 is connected at the end of the fusible link 510 that opposite to the end of the fusible link 510 connected to the fusible element 508. The arming pin connector 512 connects to an arming pin 522 that is part of the device housing (see FIG. 5*e*).

The fusible element 508 may be attached to the slider 500 via the openings 510 and protrusions 504. In particular, the fusible element 508 may be secured to the slider 500 via known crimping techniques performed on the protrusions 504 to hold the fusible element 508 down and prevent the element 508 from sliding back up the protrusions 504. Other techniques may include, depending on the material used for the slider 500 and/or the fusible element 508, laser or resistance welding, or high temperature adhesion, mechanical fasteners such as screws or rivets.

The fusible element 508 may be made of a material capable of conducting electricity. For example, the fusible element 508 may be made of copper, stainless steel, or an alloy. The diameter of the fusible link 510 may be sized so as to enable blowing the fusible link 510 with an arming current. The fusible link 510 is blown, such as by running a current through the fusible link 510, after the device is installed in a circuit to be protected. In other words, sourcing a sufficiently high current, or arming current, through the fusible link 510 may cause the fusible link 510 to open. In one embodiment, the arming current may be about 2 Amperes. However, it will be understood that the fusible link 510 may be increased or decrease in diameter, and/or another dimension, allowing for higher or lower activating currents.

Figure 5D:
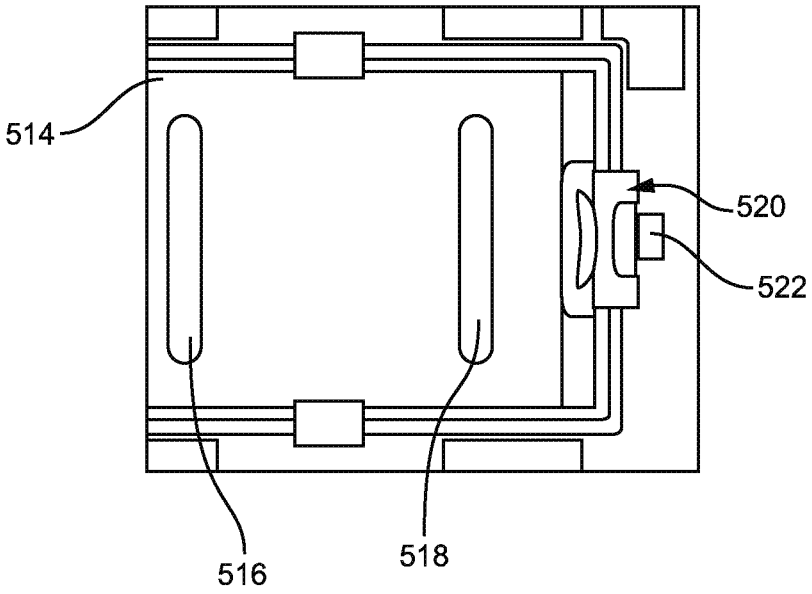

FIG. 5*d* shows an inside of a housing 514 in which the slider 500, spring 506, and fusible element 508 will be placed. At the bottom of the housing 514 there are provided solder preforms 516, 518. An underside of the housing 514 may include electrodes, e.g., surface mount pads, corresponding to teach of the solder preforms 516, 518, thus providing an electrical connection between the circuit to be protected and the slider that will be placed inside the housing 514. The housing 514 also includes an arming pin 520 through which an arming current is provided to the fusible link 510. The arming pin 520 includes a hook-like protrusion 522 over which the arming pin connector 512 may be paced.

Figure 5E:
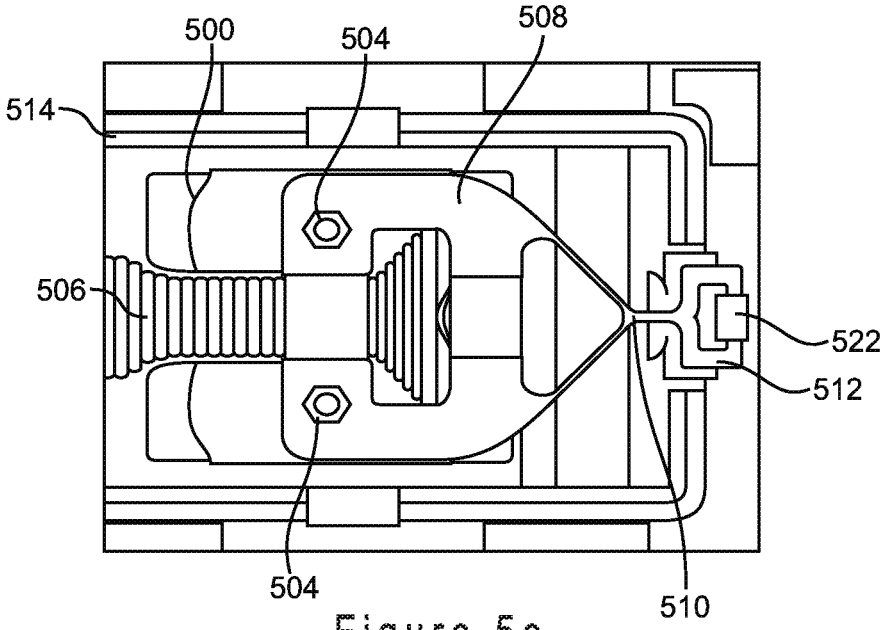

FIG. 5*e* shows that the assembly including the slider 500, spring 506, and fusible element 508 is placed in the housing 514. In particular, the arming pin connector 512 is secured to the arming pin 520. The bottom of the slider 500 is soldered to the solder preforms 516, 518. Once cooled, the solder holds the slider in place when the spring 506 is stretched (see FIG. 5*f*).

Figure 5F:
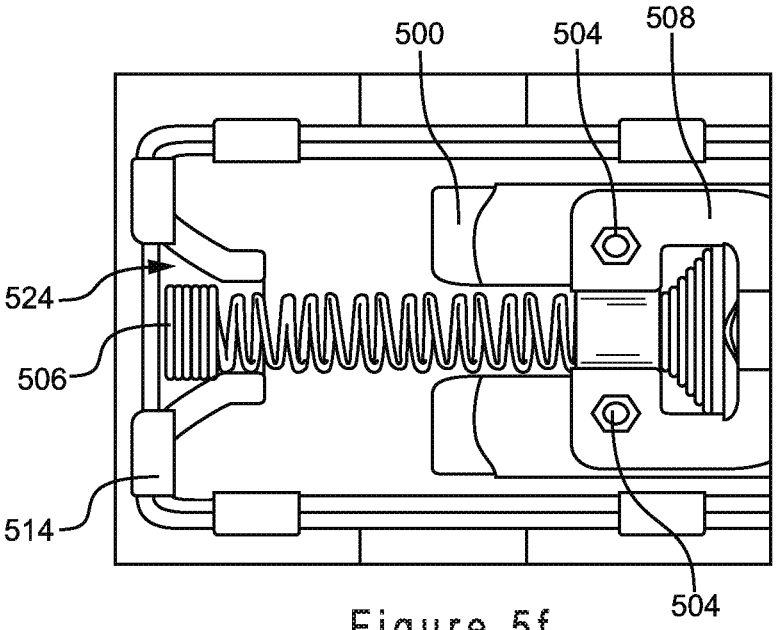

FIG. 5*f* shows that the spring 506 is then stretched. The end of the spring 506 not inserted in the slider 500 is stretched to an overmold section 524 at the opposite end of the housing. As shown in FIGS. 5*b*-5*f*, the ends of the spring 506 have a wider diameter than the middle portion of the spring 506 to allow the ends of the spring 506 to fit into the overmold 524 and the pocket 502 and remain in tension.

The resulting device is shown, for example, in FIG. 1, which is then subject to reflow in a reflow oven. During a reflow process, the solder holding the slider 500 to the outside electrodes, which would result in the slider 500 moving to an open position due to the force of the spring 506 held in tension. For example, the melt point of the solder may be approximately 140° C., while the temperature during reflow may reach more than 200° C., for example 260° C. Thus, during reflow the solder would melt, causing the spring 506 to prematurely pull the slider 500 to the open position. To prevent the force applied by the spring 506 from opening the circuit protection device during installation, the fusible link 510, which has a higher melting point than the solder, may be utilized to maintain the slider 500 in place and resist the compression force of the spring 506.

A cap (not shown) is placed over the housing using, for example, a snap-fit connection and the device is ready to be installed in a circuit to be protected. Once installed, the device is armed by applying an arming current, as discussed above, to the fusible link 510 through the arming pin 520. The fusible link 510 opens and the device is armed.

Figure 6:
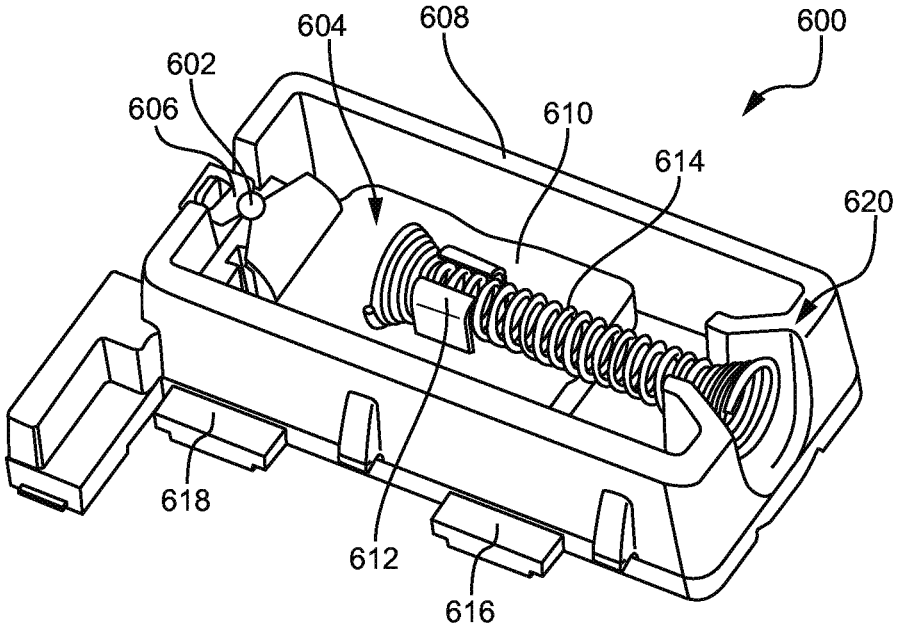
FIG. 6 is another example of a reflowable circuit protection device.

FIG. 6 is another example of a reflowable circuit protection device 600. The device 600 differs from the device 100 of FIG. 1 in that the fusible element is omitted. In FIG. 6, the fusible link 602 is part of the slider 604. For example, the slider 604 and fusible link 602 may be one contiguous part stamped out of copper. In this example, the slider 604 may include an arming pin connector 606 that hooks over (in one embodiment) or otherwise connects to the arming pin of the housing 608. The slider 604 may be made of a copper material, and the fusible link 602 being a thin strand of copper connected between the body 610 of the slider 604 and the arming pin connector 606. The fusible link 602 portion of the slider 604 is coated by an epoxy. In this example, a higher arming current, relative to the arming current required to arm the device of FIG. 1, may be required to arm the device 600 after reflow due to the lower resistance of the copper link 602. In FIG. 6, the slider 604 includes a grip portion 612 that holds one end of the spring 614 in place above the slider 604.

Similar to the device of FIG. 1, the fusible link 602 holds the slider 604 in place during reflow. After reflow, the device 600 is armed by applying an arming current through the fusible link 602. Once the device is armed, if the device overheats the solder between the slider 604 and the electrodes 616, 618 melts, causing the force of the extended spring to pull the slider 604 towards the overmold portion 620.

Figure 7:
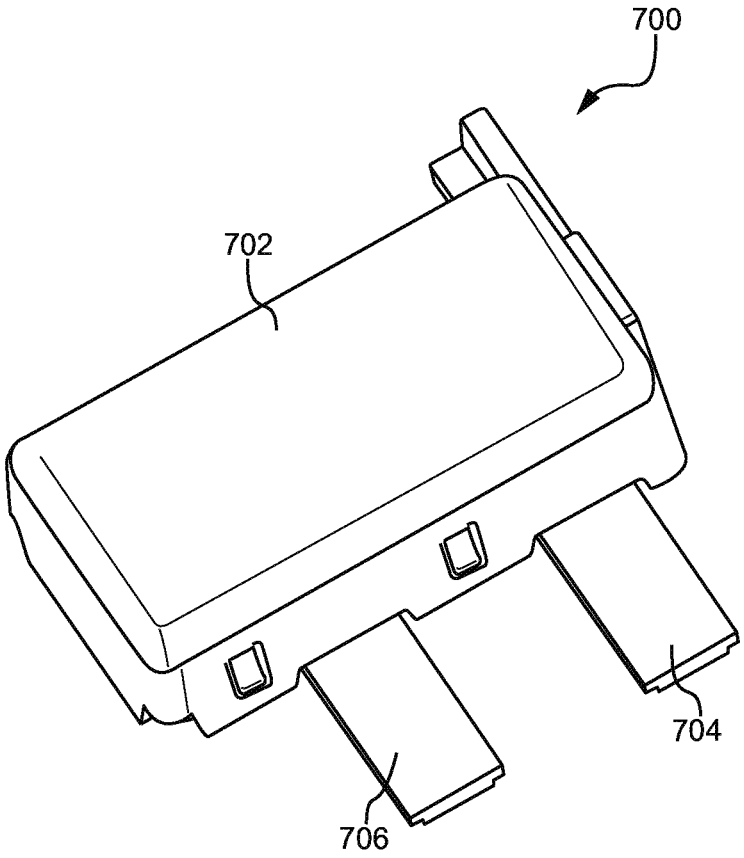
FIG. 7 shows an example of a weldable circuit protection device.

FIG. 7 shows an example of a weldable circuit protection device 700. The device 700 is shown including the cap 702 that fits over the housing. The structure inside the cap/housing may be, for example, the structure shown in FIG. 1 or FIG. 6, or FIG. 10 as described below. For a weldable device 700, the electrodes 704, 706 (i.e., lead frames) are extended relative to those of the surface mount device shown in FIG. 1 or FIG. 6. The weldable device allows the customer to install the device 700 using, for example, resistance welding. In one embodiment, the weldable device 700 may not include an arming pin or fusible link connected between the fusible element and the arming pin.

Figure 8:
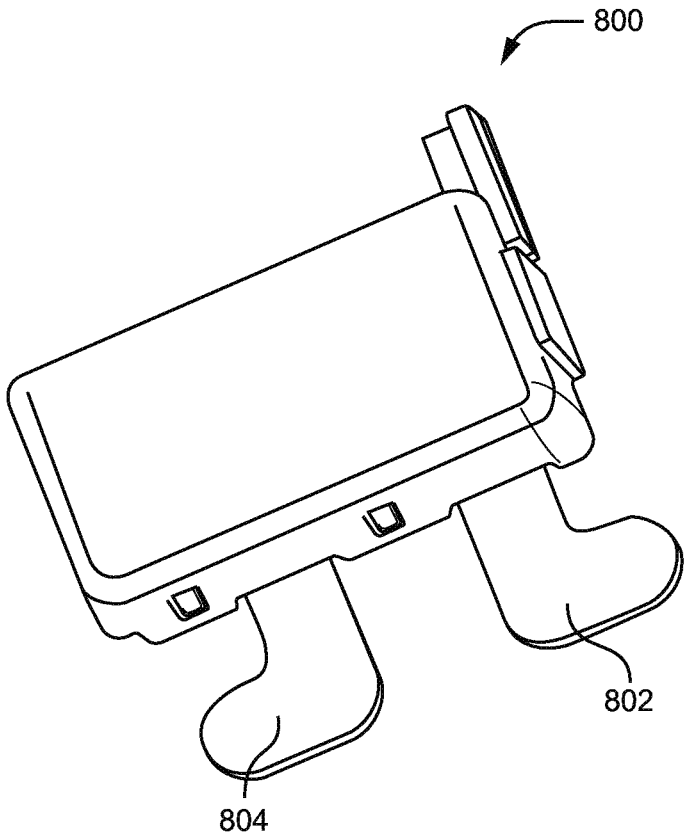
FIG. 8 shows another example of a weldable circuit protection device.
Figure 9:
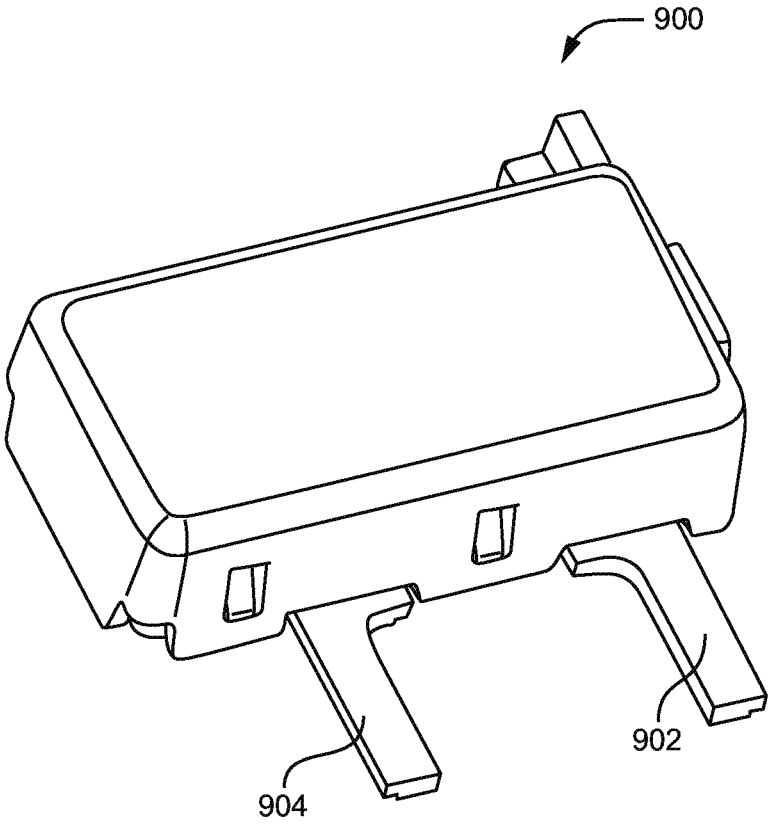
FIG. 9 shows yet another example of a weldable circuit protection device.

FIGS. 8-9 show other examples weldable devices 800 and 900. Each of the devices 800 and 900 include electrodes 802, 804 and 902, 904, respectively, having different shapes according to a client's needs.

Figure 10:
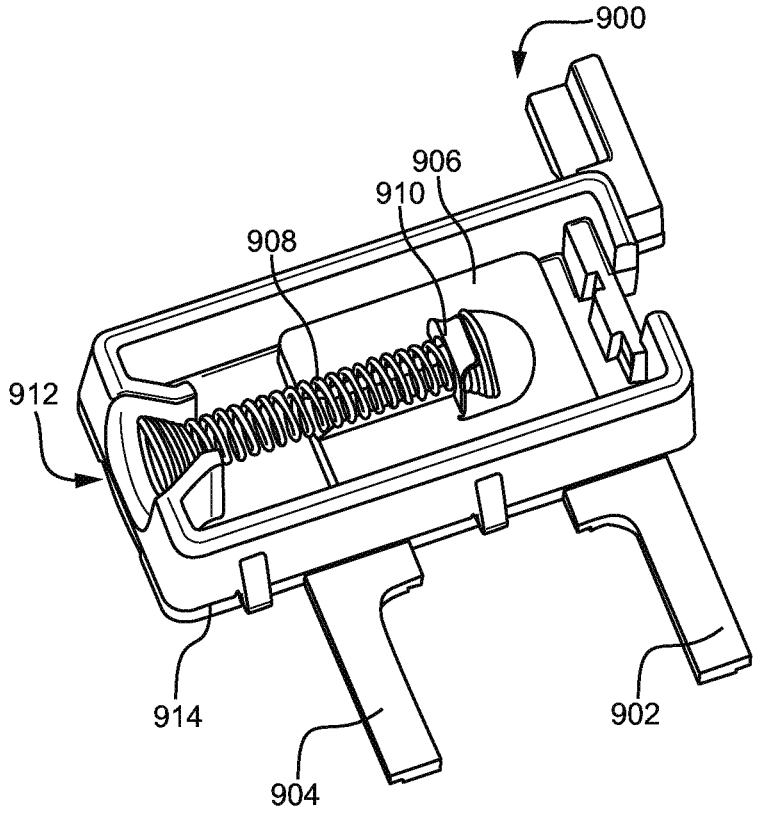
FIG. 10 shows an example of the subassembly structure inside the device of FIG. 8.

FIG. 10 shows an example of the subassembly structure inside the device 900. As noted above, in one embodiment the weldable device 700 may not include an arming pin or fusible link connected between the fusible element and the arming pin, which is illustrated in FIG. 10. The device 900 includes a slider 906 and a spring 908. The slider 906 includes a grip portion 910 that holds one end of the spring 908 to the slider 906. The other end of the spring 908 is held by the overmold portion 912 of the housing 914.

Figure 11:
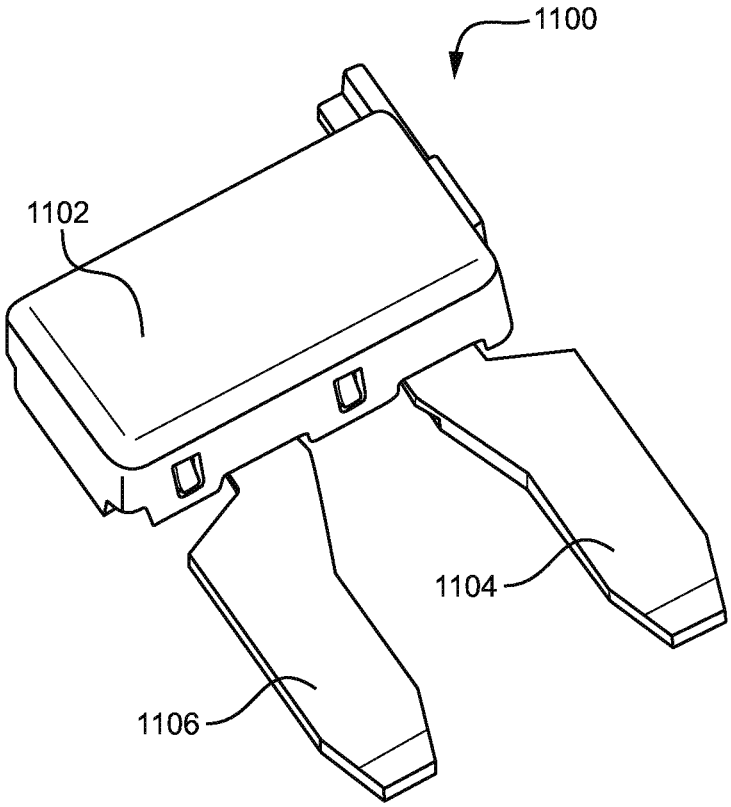
FIG. 11 shows an example of a pluggable circuit protection device.

FIG. 11 shows an example of a pluggable circuit protection device 1100. The device 1100 is shown including the cap 1102 that fits over the housing. The structure inside the cap/housing may be, for example, the structure show in FIG. 1, 6, or 10. The pluggable circuit protection device 1100 includes electrodes 1104, 1106 structured to be able to be plugged into a receptacle on a circuit board or other circuit. The pluggable device 1100 may be a single-use fuse structured to be plugged into a fuse box.

Figure 12A:
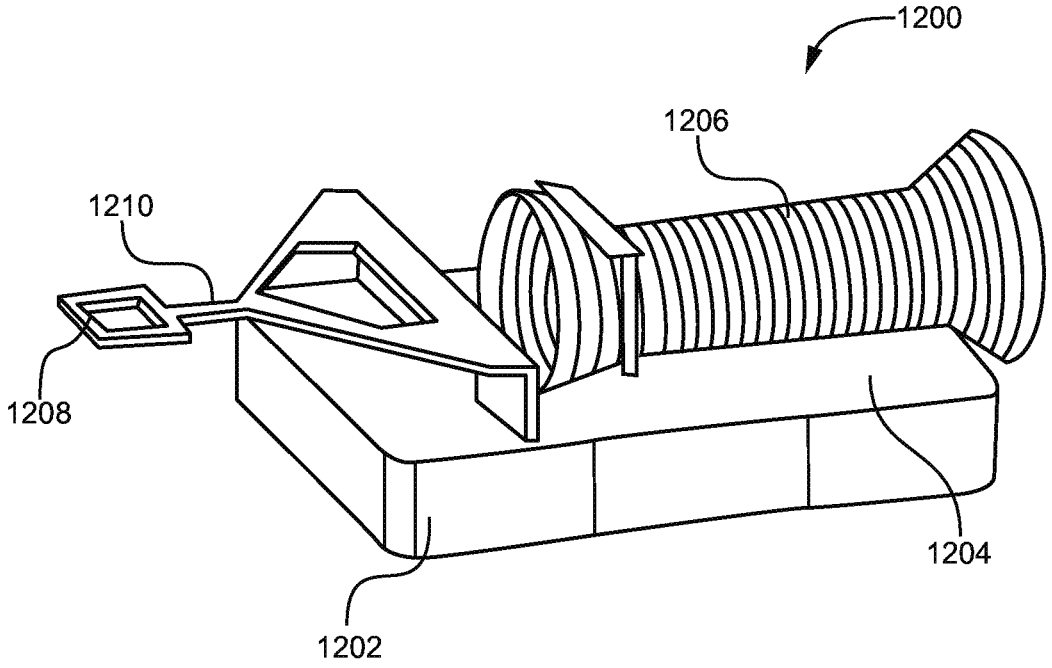
FIGS. 12*a-d* illustrate selected parts of a reflowable circuit protection device.

FIGS. 12*a-d* illustrate selected parts of a reflowable circuit protection device. FIG. 12*a* shows a slider subassembly 1200 of the device including a stamped slider 1202, a fusible element 1204, and a helical tension spring 1206. The subassembly 1200 includes an arming pin connector 1208 and a fusible link 1210 connected between the fusible element 1204 and the arming pin connector 1208. Similar to FIG. 1, the slider 1202 may be made of copper. The fusible element 1204 in this example is attached to the slider 1202 by laser welding. The slider of in the device of FIG. 1 included a pocket in which a substantial portion of the spring was inserted. In the subassembly 1200 of FIG. 12*a*, the slider 1202 may also include a smaller pocket that receives a portion of the end of the spring 1206 to allow the length of the spring 1206 over the fusible element 1204 to lay flush with the fusible element 1204.

Figure 12B:
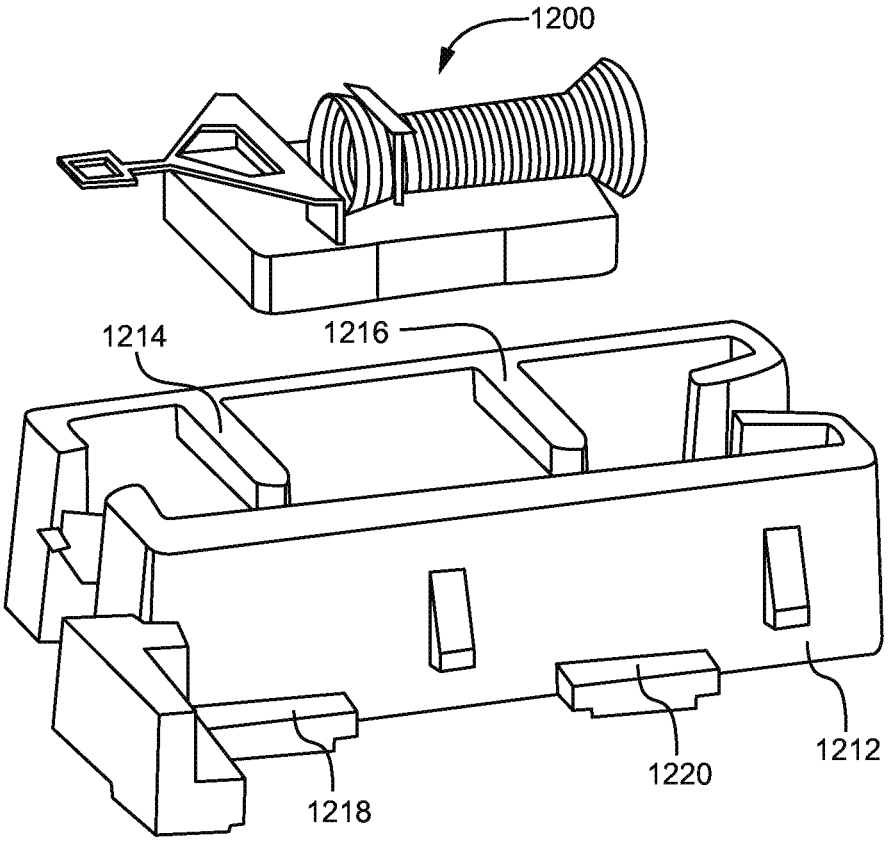

FIG. 12*b* illustrates that the subassembly 1200 of FIG. 12*a* is inserted into the housing 1212. FIG. 12*b* also shows two solder preforms 1214, 1216 applied above the electrodes 1218, 1220. The subassembly 1200 is inserted after the solder preforms 1214, 1216 are applied.

Figure 12C:
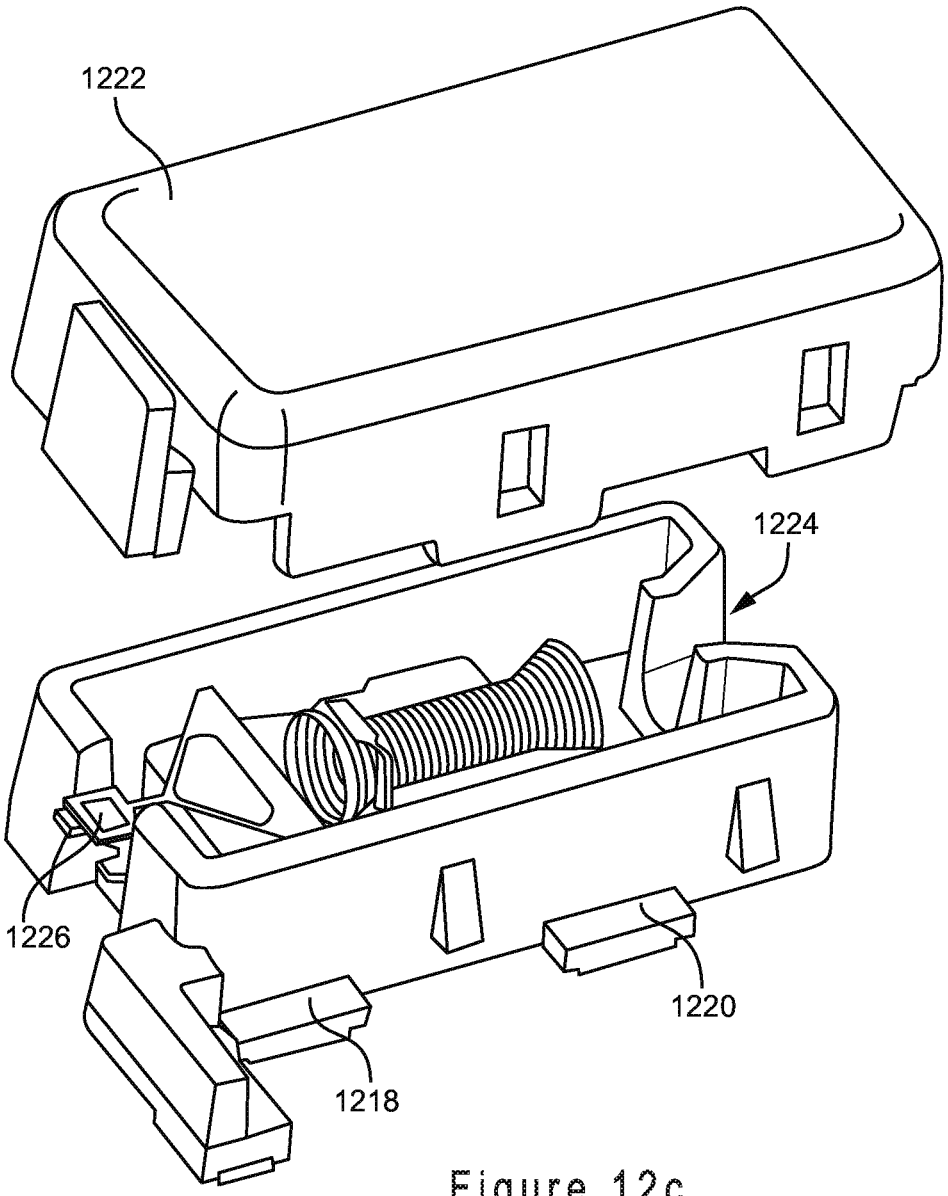

FIG. 12*c* illustrates that a cap 1222 is placed over the housing 1212. In this example, the cap 1222 snaps onto the housing 1212. Before the cap 1222 is snapped onto the housing, the spring 1206 is stretched and the end of the spring 1206 not secured to the slider 1202 is inserted into the overmold portion 1224 of the housing 1212 to place the spring 1206 in tension. In addition, a solder paste may be applied to arming pin 1226 of the housing. A purpose of solder paste is to ensure high reliability conductive connection between between the arming pin and the arming pin connector. The arming pin may also be pre-tinned.

Figure 12D:
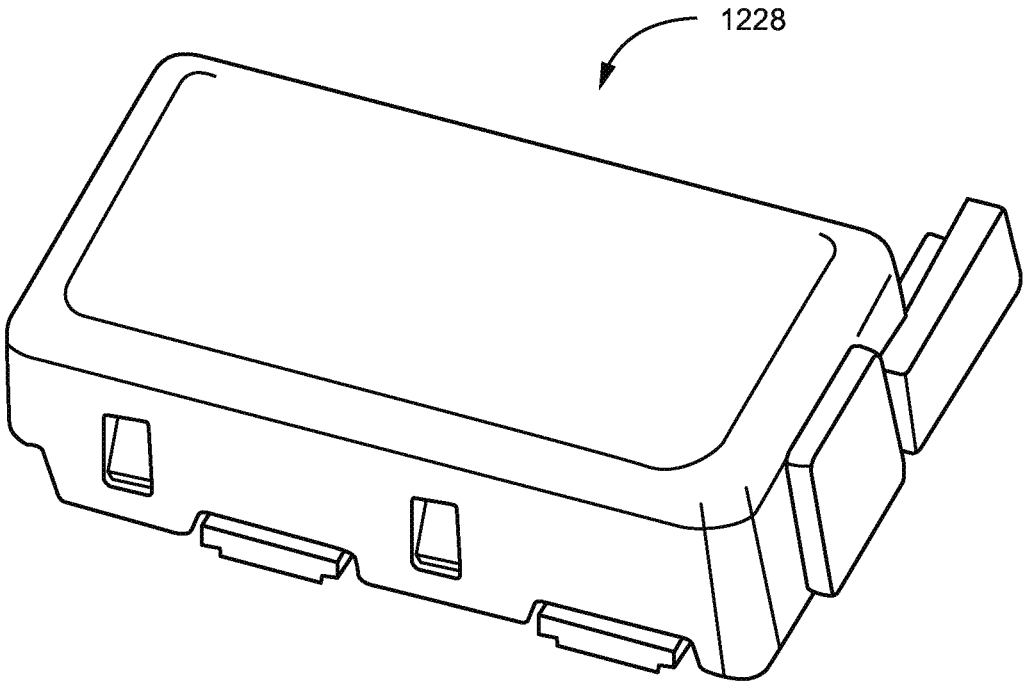

FIG. 12*d* shows the assembled device 1228. After assembly, the device 1226 may be subject to reflow in a reflow oven.

Figure 13:
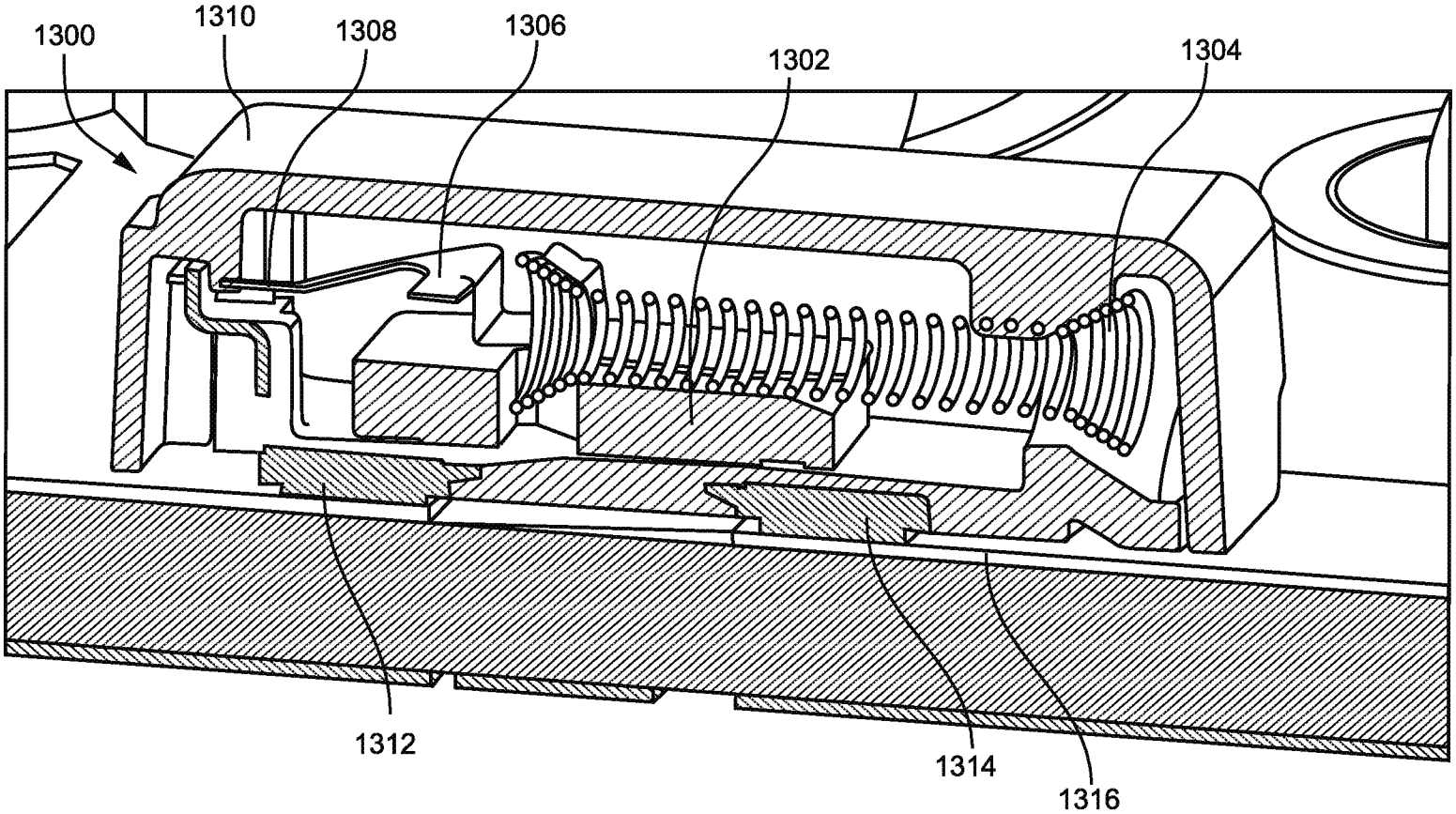
FIG. 13 shows a cross-section of a circuit protection device including a capillary break.

FIG. 13 shows a cross-section of a circuit protection device 1300 including a capillary break. The device 1300 includes a slider 1302, spring 1304, fusible element 1306, fusible link 1308 within a housing 1310. The device 1300 also includes electrodes 1312 and 1314 mounted on a circuit board 1316.

Figure 14:
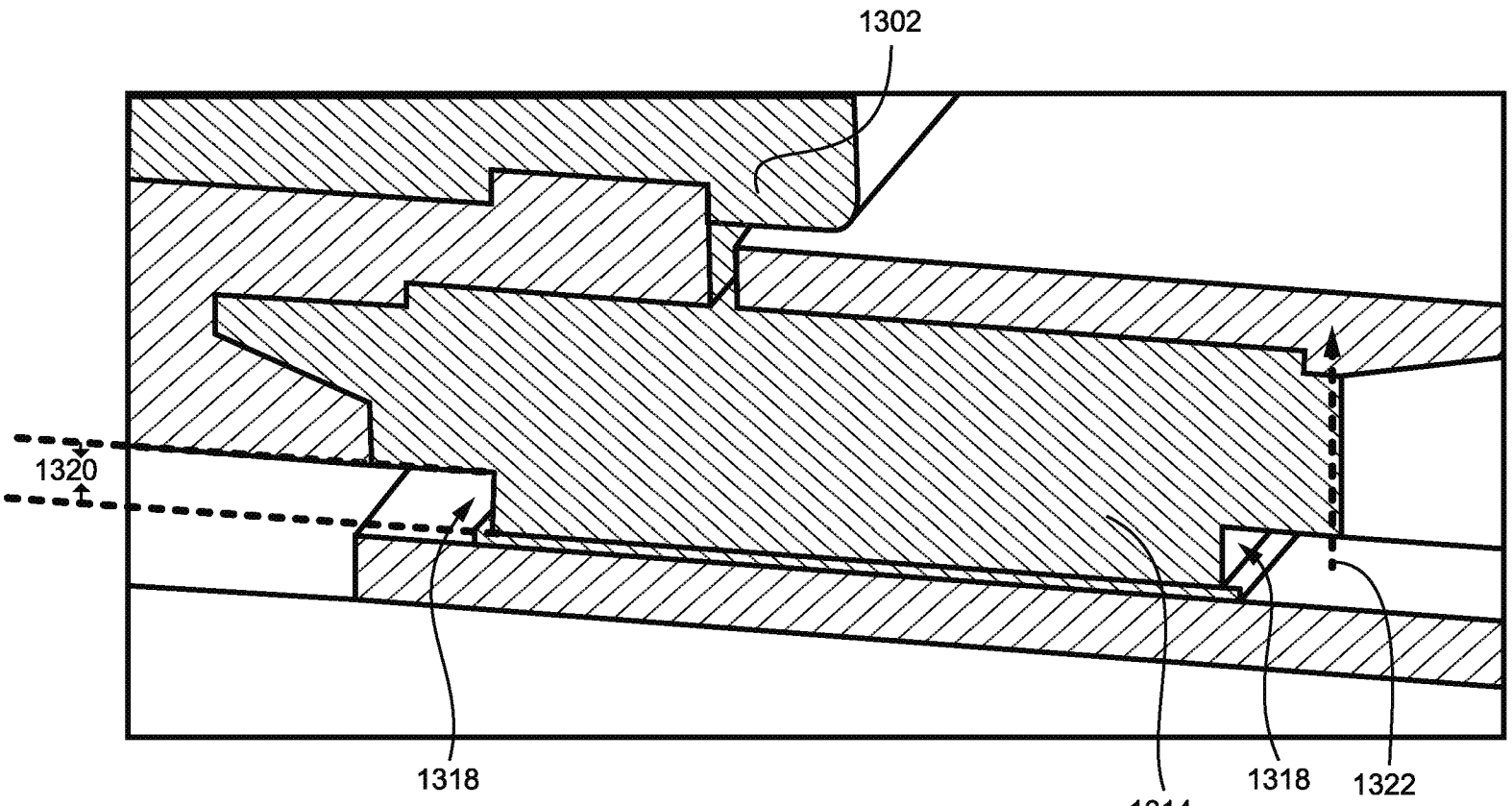
FIG. 14 shows a zoomed-in view of the electrode of the device shown in FIG. 13.

FIG. 14 shows a zoomed-in view of the electrode 1314 of FIG. 13. The sides of the electrodes 1312 and 1314 each include a cutout portions 1318 forming a stepwise contour to the bottom sides of the electrodes 1312 and 1314, thereby creating a space 1320, i.e., capillary break, between the bottom surface of the housing 1310 and the circuit board 1316. The capillary break prevents liquid flux on the circuit board 1316 that may melt during reflow from following, by capillary force, the capillary path 1322.

While the circuit protection device has been described with reference to certain embodiments, it will be understood by those skilled in the art that various changes may be made and equivalents may be substituted without departing from the scope of the claims of the application. In addition, many modifications may be made to adapt a particular situation or material to the teachings without departing from its scope. Therefore, it is intended that the reflowable circuit protection device is not to be limited to the particular embodiments disclosed, but to any embodiments that fall within the scope of the claims.

What is claimed is:

1. A circuit protection device comprising:

a housing comprising:

a first electrode;

a second electrode; and an arming pin;

a spring inside the housing, the spring comprising a first end and a second end, the first end of the spring being secured to an inside edge of the housing;

a conductive slider inside the housing, the slider comprising a pocket defined within at least a portion of the slider, the pocket receiving at least a portion of the second end of the spring, and the spring being held in tension between the pocket and the inside edge of the housing, and the slider sliding from a first location to a second location within the housing such that at the first location the slider provides an electrical connection between the first and second electrodes, and at the second location the slider does not provide an electrical connection between the first and second electrodes; and a fusible element attached to the slider, the fusible element having as an integral part a fusible link providing an electrical connection between the slider and the arming pin, the fusible link (i) holding the slider at the first location during a reflow process, and (ii) opening upon application of an arming current to the arming pin after the reflow process, wherein (i) the slider comprises at least one protrusion extending up from an upper surface of the slider, (ii) the fusible element comprises at least one opening matching the at least one protrusion, and (iii) the at least one opening receives the matching at least one protrusion.

2. The circuit protection device of claim 1, further comprising a solder between the slider and each of the first and second electrodes.

3. The circuit protection device of claim 2, wherein the solder holds the slider at the first position after the fusible link is opened by application of the arming current.

4. The circuit protection device of claim 2, wherein upon detection of an over-temperature condition, the solder melts and the spring is configured to compress, pulling the slider to the second position.

5. The circuit protection device of claim 2, wherein the fusible link opens at a temperature higher than the melting point of the solder.

6. The circuit protection device of claim 1, wherein the at least one protrusion is crimped to prevent the fusible element from sliding up off the slider.

7. The circuit protection device of claim 1, wherein the fusible element is attached to the slider by laser welding or a mechanical fastener.

8. The circuit protection device of claim 1, wherein a direction of sliding between the first and second locations is parallel to the length of the slider.

9. The circuit protection device of claim 1, wherein the arming pin is located at an end of the housing that is opposite to an end of the housing at which the inside edge secured to the first end of the spring is located.

10. A circuit protection device comprising:

a housing comprising:

a first electrode;

a second electrode; and an arming pin;

a spring inside the housing, the spring comprising a first end and a second end, the first end of the spring being secured to an inside edge of the housing;

a conductive slider inside the housing, the slider sliding from a first location to a second location within the housing such that at the first location the slider provides an electrical connection between the first and second electrodes, and at the second location the slider does not provide an electrical connection between the first and second electrodes, the slider comprising:

a body portion having a pocket defined within at least a portion of the slider, the pocket receiving at least a portion of the second end of the spring, and the spring being held in tension between the pocket and the inside edge of the housing; and a fusible element attached to the slider, the fusible element having as an integral part a fusible link connected between the body portion of the slider and the arming pin, the fusible link holding the slider at the first location during a reflow process, and opening upon application of an arming current to the arming pin after the reflow process, wherein (i) the slider comprises at least one protrusion extending up from an upper surface of the slider, (ii) the fusible element comprises at least one opening matching the at least one protrusion, and (iii) the at least one opening receives the matching at least one protrusion.

11. The circuit protection device of claim 10, wherein the fusible link is coated with an epoxy.

12. The circuit protection device of claim 10, further comprising a solder between the slider and each of the first and second electrodes.

13. The circuit protection device of claim 12, wherein the solder holds the slider at the first position after the fusible link is opened by application of the arming current.

14. The circuit protection device of claim 12, wherein upon detection of an over-temperature condition, the solder melts and the spring is configured to compress, pulling the slider to the second position.

15. The circuit protection device of claim 10, wherein a direction of sliding between the first and second positions is parallel to the length of the housing.

* * * * *